US007699687B2

(12) United States Patent
Nordstrom

(10) Patent No.: US 7,699,687 B2
(45) Date of Patent: Apr. 20, 2010

(54) COMPACT ELECTRIC SANDING MACHINE

(75) Inventor: Caj Nordstrom, Jeppo (FI)

(73) Assignee: Oy KWH Mirka AB (FI)

( * ) Notice: Subject to any disclaimer, the term of this patent is extended or adjusted under 35 U.S.C. 154(b) by 5 days.

(21) Appl. No.: 11/844,162

(22) Filed: Aug. 23, 2007

(65) Prior Publication Data

US 2008/0233848 A1 Sep. 25, 2008

(30) Foreign Application Priority Data

Mar. 21, 2007 (FI) ..... 20075183

(51) Int. Cl.
*B24B 23/00* (2006.01)

(52) U.S. Cl. ..... 451/359; 318/400.3

(58) Field of Classification Search ..... 451/353, 451/359; 318/400.3
See application file for complete search history.

(56) References Cited

U.S. PATENT DOCUMENTS

| | | | | |
|---|---|---|---|---|
| 0,245,182 | A | 8/1881 | Levalley | |
| 5,239,783 | A | 8/1993 | Matechuk | |
| 5,710,474 | A * | 1/1998 | Mulgrave | 310/254 |
| 6,570,353 | B2 * | 5/2003 | Krotsch et al. | 318/400.24 |
| 7,115,018 | B1 * | 10/2006 | Syverson | 451/6 |
| 2004/0124721 | A1 * | 7/2004 | Pfisterer et al. | 310/51 |
| 2005/0245182 | A1 | 11/2005 | Deshpande et al. | |
| 2005/0245183 | A1 | 11/2005 | Deshpande et al. | |

FOREIGN PATENT DOCUMENTS

| | | |
|---|---|---|
| EP | 0727281 A1 | 8/1996 |
| GB | 2419559 | 5/2006 |
| JP | 6189516 | 7/1994 |
| WO | WO 9109449 A1 * | 6/1991 |
| WO | WO0123137 | 4/2001 |

* cited by examiner

*Primary Examiner*—Maurina Rachuba
(74) *Attorney, Agent, or Firm*—Altera Law Group LLC

(57) ABSTRACT

The present invention particularly relates to a hand-held sanding machine with an outer housing (1), a tool shaft (2) and a brushless electric drive motor. In the present invention, the rotor of the drive motor is fastened to the tool shaft (2) of the sanding machine, and the stator (6) is positioned in the outer housing (1). The present invention also relates to a control method for an electric sanding machine.

17 Claims, 7 Drawing Sheets

SECTION A–A

SECTION A–A

SECTION B–B

COMPACT ELECTRIC SANDING MACHINE

TECHNICAL FIELD

The present invention relates to an electric hand-held sanding machine with an outer housing and a tool shaft, characterized in that it has a brushless electric motor without a shaft of its own, mounted in such a way that the rotor is fastened to the tool shaft and the stator is positioned in the outer housing and forms in this way a compact sanding machine. The compact structure enables a manner of use and a device in the form of an arm that can be fastened to the sanding machine for a comfortable two-hand grip and an extended range of operation for the machine.

PRIOR ART

Electric sanding machines of the same type are previously known from, for example, U.S. Pat. No. 0,245,182. Here, the intention has been to make a relatively compact and low sanding machine by using a brushless motor and making the proportion between the motor diameter and the motor height great. The drawback of this solution is that the motor diameter unavoidably becomes large and therefore also difficult to be gripped with one hand. Further, since the diameter is large, it becomes disadvantageous to make a hermetic motor with cooling only on the outside. This is very disadvantageous because the air in which the sanding machine is most often used is filled by dust particles that may be both electrically conductive and grinding by nature.

Since electric sanding machines have previously been so large and heavy, it has been necessary to have special sanding machines in, for example, wall grinding. Machines of this type are previously known from, for instance, U.S. Pat. No. 5,239,783 or EP0727281. In these patents, a sanding machine for walls has been made by moving the motor to the far end of the arm and by, for example, using a cable for transmitting power to the grinding head. In this way, balance has been achieved for the machine, but this also makes the machine expensive and difficult to manufacture.

Within the EU and many other markets, there are regulations on how much interference may be generated to the network. Within the EU, standard EN61000-3-2 with amendment A14 is applied. If a switched control unit is made in the simplest way possible by rectifying the mains voltage according to FIG. 5 and subsequently having so large a capacitor that the following control can continuously take current until the following pulse comes, very high harmonic components are obtained which interfere with the electric network.

There are two conventional ways of solving this problem: A passive way by filtering the current and voltage with inductances and capacitors, and an active way. The passive way requires space as well as a great volume and weight. The active way functions in such a way that the voltage is first switched with the known "step-up" topology according to FIG. 6 in such a way that the relation between the input current and the input voltage corresponds to a resistive load. The output voltage is always higher than the top value of the input voltage. The drawback with the active way is that the current goes through an extra inductance L1 and is, in addition, switched one more time, because the power correction is always followed by a switched control unit.

DEFINITION OF THE PROBLEM

An object of the present invention is to alleviate above-mentioned disadvantages. The sanding machine according to the invention is characterized in that it has an electric drive motor that is brushless and without a shaft of its own, mounted in such a way that the rotor is fastened to the tool shaft and the stator is positioned in the outer housing. A sanding machine constructed in this way has a compact structure allowing the sanding machine to be gripped ergonomically with one hand. At the same time, the invention enables a hermetic structure in which the cooling air passes only on the outside of the stator and which is thus very insensitive to impurities in the cooling air. Since the sanding machine also has a low profile, the control of the grinding properties of the machine is good.

The motor type used in the invention is what is called BLDC (Brushless Direct Current) motor. Due to the strong magnetic field of the new NdFeB magnets, the motor has high power per volume and high efficiency. Thanks to these features, it has been possible to make the motor sufficiently small to enable this invention. An advantageous solution is to use a slotless version of the BLDC motor. The slotless motor has smaller iron losses and a more advantageous price because the iron core of lamination stacks has a simpler form, and the winding is simpler to carry out.

The cooling air is generated by a blower that is mounted on the tool shaft and can advantageously be integrated in the same vertical direction as the balance weights of the tool shaft. The same cooling air that cools the motor first cools the control unit.

Since, thanks to the present invention, the sanding machine is much lighter and more compact than known electric sanding machines, special sanding machines intended for wall grinding have become completely unnecessary. Previously, it has been necessary to make the grinding head lighter by moving the motor to the other end of the arm but with the consequence that transmission with a cable or shafts is needed. The present sanding machine can be fastened to the end of an arm in such a way that it is freely mobile in one or more flexible directions. Since the sanding machine is so light, it is still as easy to handle as special wall sanding machines having complicated and expensive transmission. If dust extraction is needed, it is advantageous to lead the extraction to a hollow arm.

Control of the motor is carried out electronically to be able to vary the speed of rotation. The control unit is made in such a way that the speed of rotation is kept on a given level irrespective of the load of the machine. The control unit may preferably be positioned in connection with the sanding machine. A preferable solution is to use sensorless control, i.e. control without a sensing device to determine the position of the rotor in the electronic commutation. The sensorless control usually utilizes the voltage generated in the phase that is not conducting to determine the position of the rotor.

The position of the rotor in the electric commutation can also be determined on the basis of the currents generated in the different phases or the relation between current and voltage in the phases.

When the control is sensorless, the motor is more compact because the sensors, most often Hall sensors, make the motor considerably longer.

According to the new preferred solution for a switched control unit, the motor is dimensioned in such a way that the nominal voltage of the motor is lower than the top value of the rectified mains voltage. When current is consumed during that part of the cycle when the voltage is higher than the nominal voltage of the motor and no current is consumed when the voltage is lower than the nominal voltage of the motor, different degrees of power correction are obtained, depending on how much lower the nominal voltage is. If the time during which the current corresponds to an optimal load in relation to the whole cycle is sufficiently long, the harmonic components generated back to the electric network will be within the allowed values. When mains voltage of 230 V is rectified, a top value of 325 V is obtained. If the nominal voltage of the motor is, for example, 200 V, there is a current flow approximately 60% of the time. The current is generated in such a way that no current flows when the rectified mains voltage is equal to the nominal voltage, and it increases linearly in such a way that the current is 10 A when the voltage is 325 V. This gives an effective power of approximately 1,100 W. The third harmonic current component is thus 2.4 A, which is within the allowed limit for a portable hand tool. The other harmonic components also have allowed values. Since the windings of the motor form a coil with self-inductance L1, the switched control unit can also be preferably made without external inductances.

BRIEF DESCRIPTION OF THE FIGURES

The invention is described in more detail in the following with reference to the attached drawings, in which.

PREFERRED EMBODIMENTS

Figure 1:
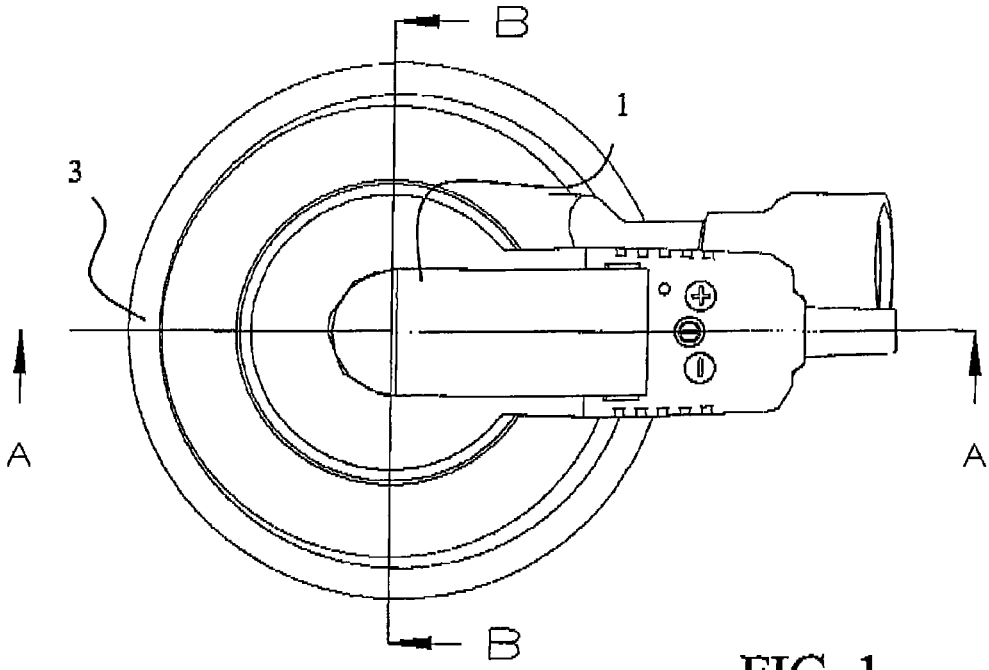
FIG. 1 shows a top view of the sanding machine.
Figure 2:
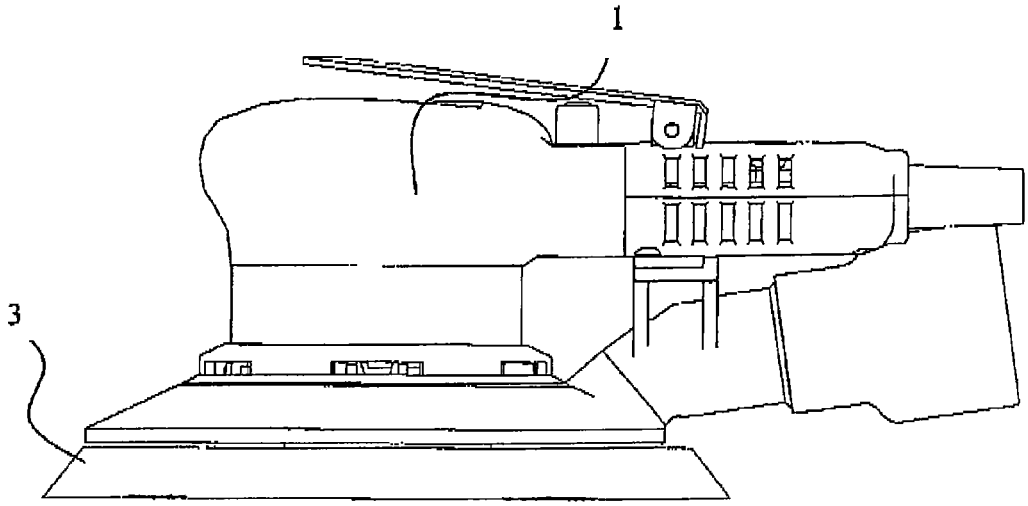
FIG. 2 shows a side view of the sanding machine.
Figure 3:
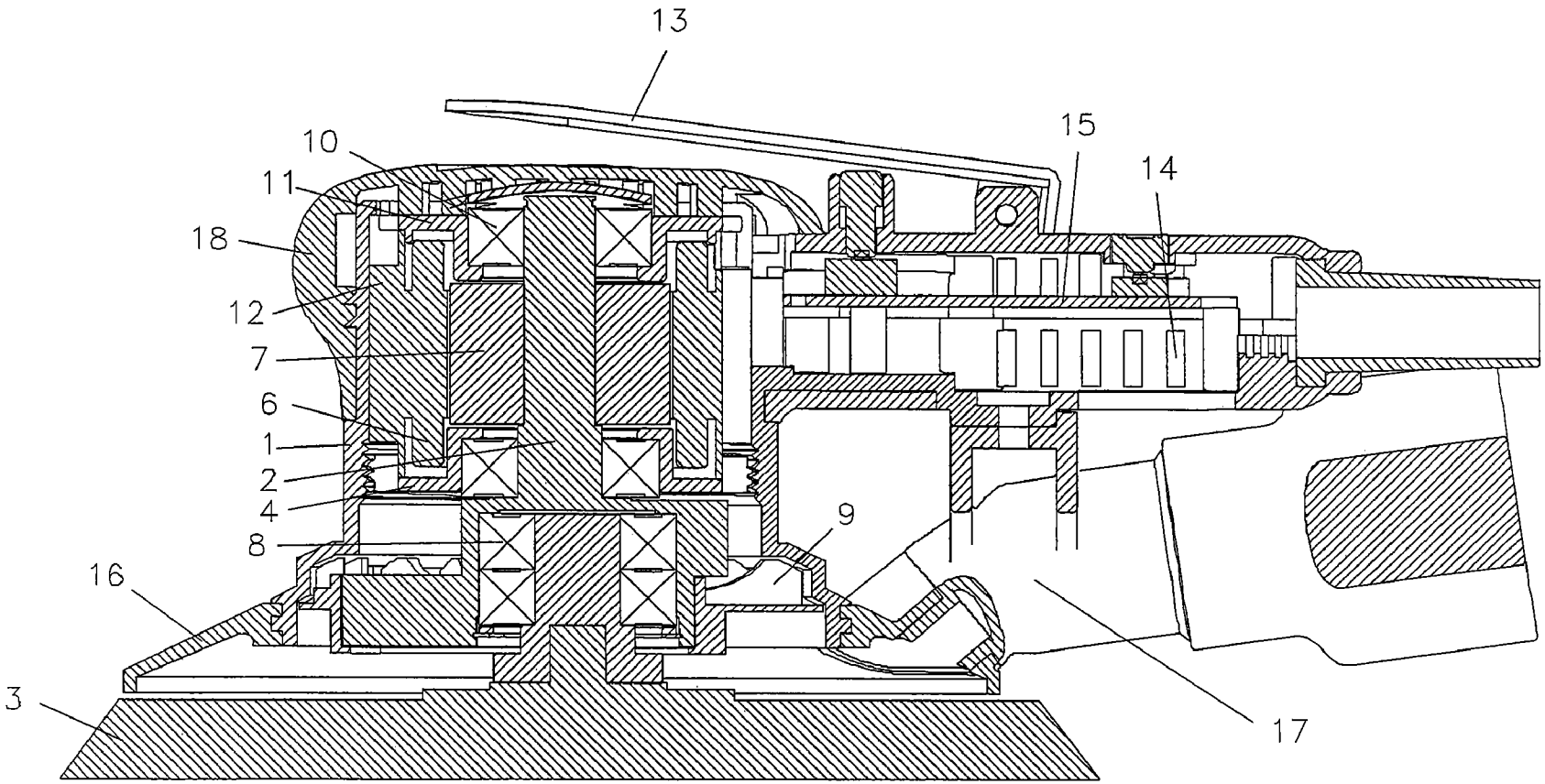
FIG. 3 shows a cross-section along line A-A.
Figure 4:
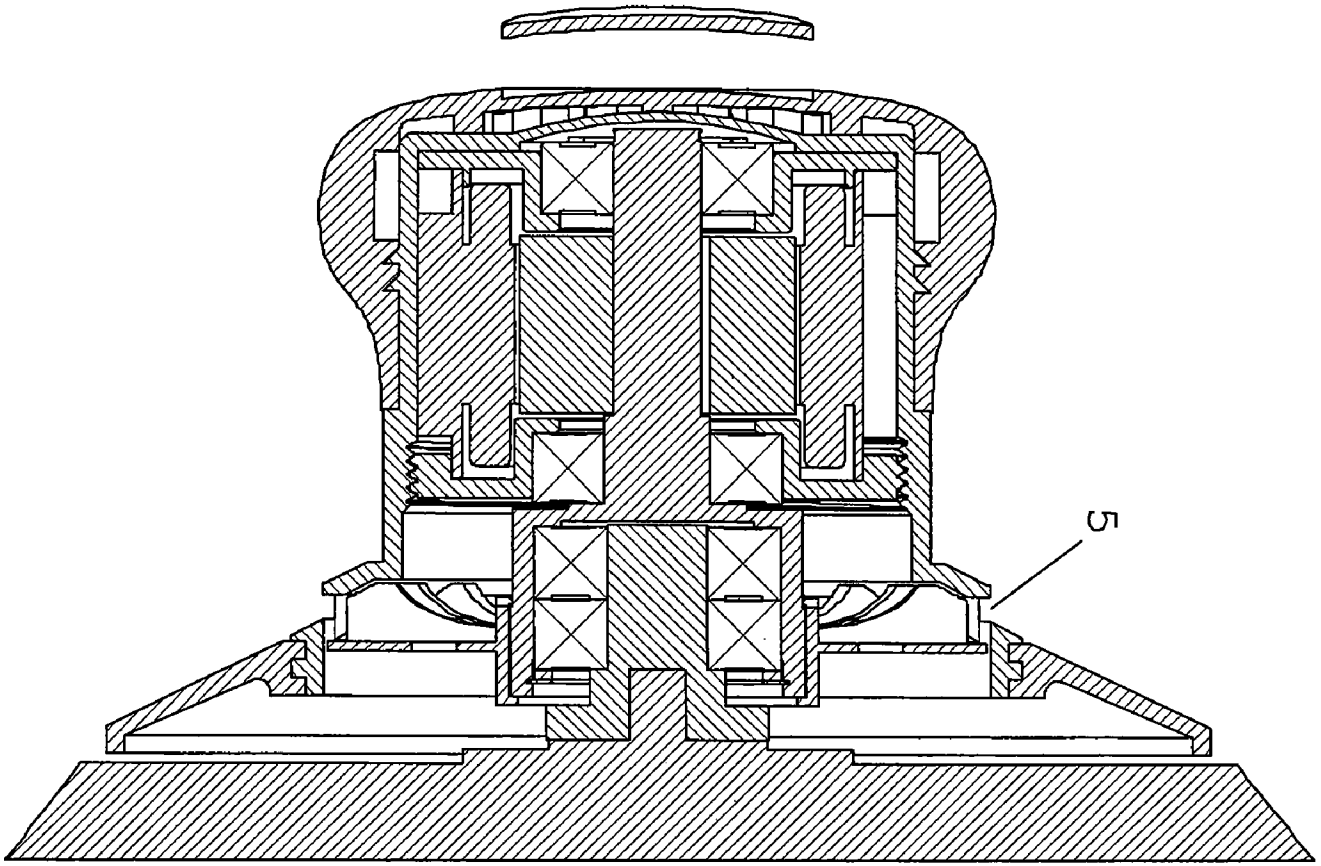
FIG. 4 shows a cross-section along line B-B.
Figure 5:
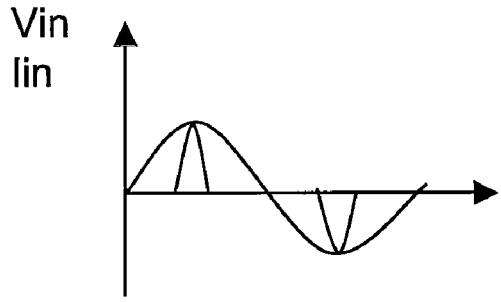
(PRIOR ART) FIG. 5
FIG. 5 shows an electricity drawing of prior art control.
Figure 5:
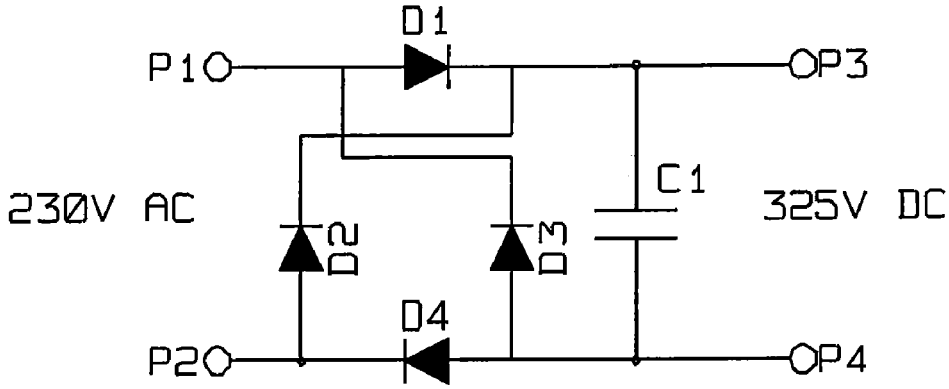
(PRIOR ART) FIG. 5
Figure 6:
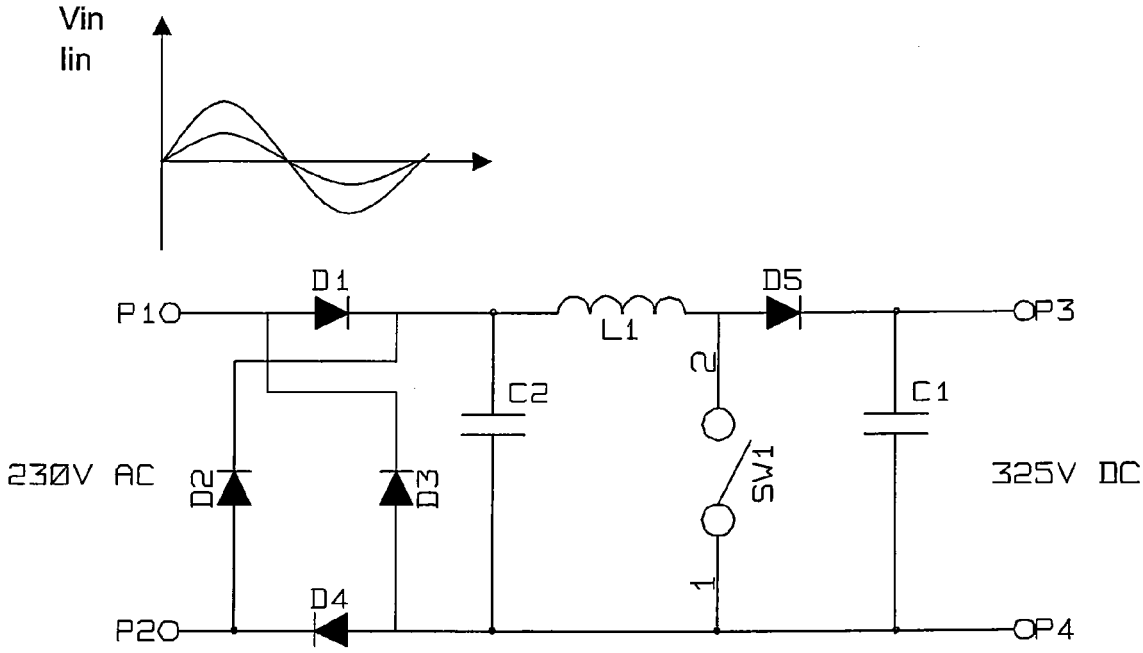
(PRIOR ART) FIG. 6
FIG. 6 shows prior art power correction.

The sanding machine shown in FIGS. 1 to 4 is formed of a housing 1 enclosing all parts of the motor. The motor is formed of a stator 6, including a casing with cooling fins 12 and a rotor 7. These parts are integrated with the parts keeping a tool shaft 2, a bearing housing at both ends 4, 11 and a bearing 10 in place, in such a way that the rotor 7 is fastened to the tool shaft 2. The casing and cooling fins of the stator 6 are shaped in such a way that an air slot is generated which is limited by the casing, the housing of the sanding machine and the cooling fins. The grinding disc 3 is fastened freely rotationally to the tool shaft 2 via an eccentric bearing 8. The blower 9, which is fastened to the tool shaft 2 preferably at the same height as the balance weights, sucks in air through the hole 14. The air cools the control unit 15 and then the motor via the cooling fins 12. The air is blown out through the hole 5. The shroud 16 collects the grinding dust that is sucked out through the grinding disc 3 and further out through the extraction pipe 17. The switch 13 is in connection with the control unit and attends to the switching on and switching off ergonomically. A soft part 18 around the casing makes the machine grip-friendly. In another embodiment, the disc is not freely rotating, but the disc is rotating with or without eccentric movement through a connection to the tool shaft 2.

In another embodiment, the dust extraction also attends to the cooling of the motor in such a way that part of the air is sucked via the motor and the cooling fins, and in this way the motor cools off without a separate blower.

Figure 7:
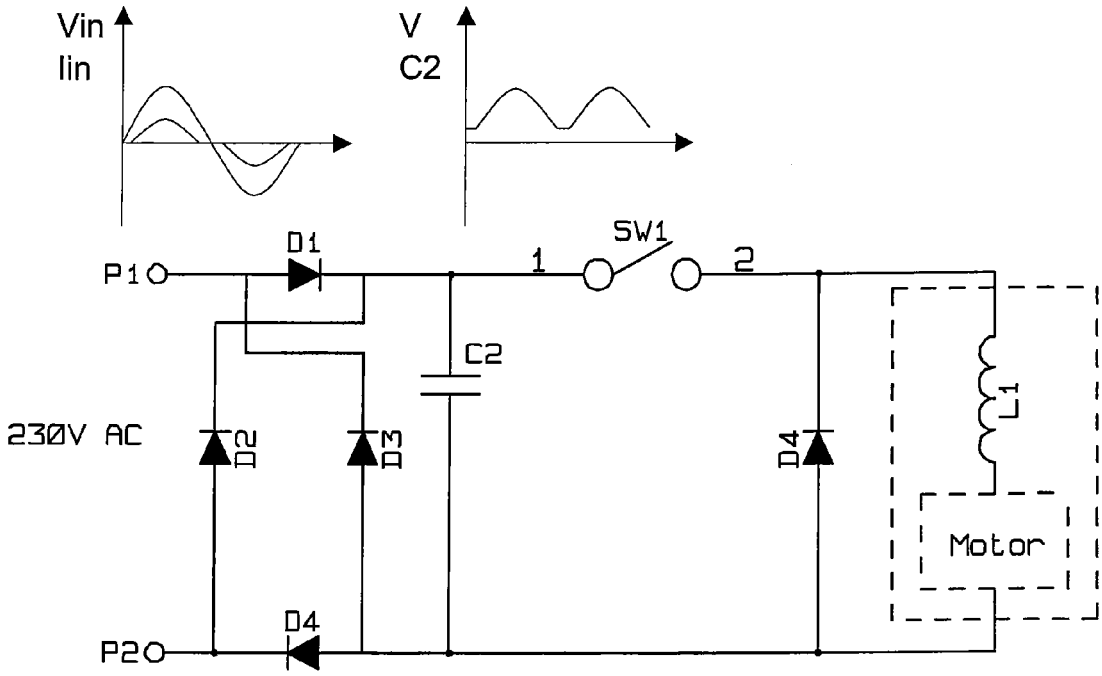
FIG. 7 shows a first embodiment of new motor control.

Functioning of the power correction of the control unit in a first embodiment is described in FIG. 7. The mains voltage is rectified and the following capacitor C2 is so small that the voltage follows the rectified voltage. The motor is dimensioned in such a way that the nominal voltage of the motor is so much lower than the top value of the rectified mains voltage in relation to the required power that power correction is obtained when current is consumed during that part of the cycle when the voltage is higher than the nominal voltage of the motor and no current is consumed when the voltage is lower than the nominal voltage of the motor. The control unit utilizes the well-known "step-down" topology in such a way that the relation between current and voltage is optimized so that smallest harmonic components possible are generated, and thus also the best possible power correction is achieved in that part of the cycle in which the voltage is higher than the nominal voltage of the motor. If the voltage is lower than the nominal voltage, no power is taken to the motor. If the time when the current corresponds to the optimal load in relation to the whole cycle is sufficiently long in relation to the required power, the harmonic components generated back to the electric network will be within allowed values. If the self-inductance L1 of the motor is sufficiently great, the control unit can preferably be made without external inductances. The motor in FIG. 7 has been simplified in such a way that only one switch SW1 is shown. In practice, electronically commutated 3-phase control is directly carried out for the motor.

Figure 8:
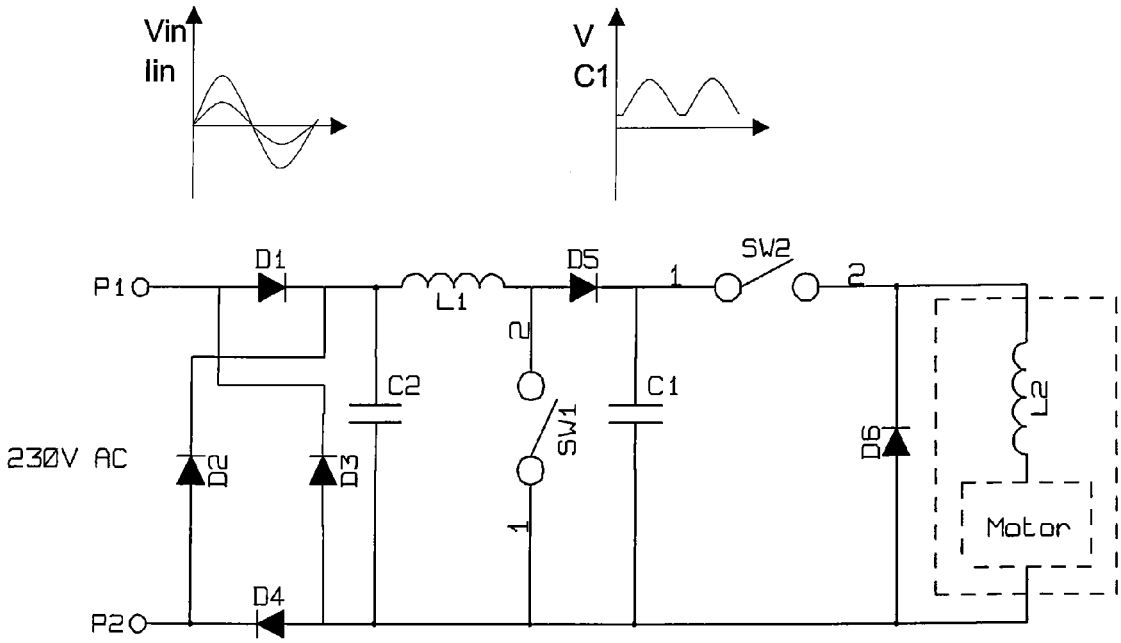
FIG. 8 shows a second embodiment of the motor control.

If the power correction obtained is not sufficient, the function can be further improved according to the embodiment in FIG. 8. Here, an external inductance L1 and an extra switch according to "step-up" topology have been incorporated to carry out power correction also during the time when the voltage is lower than the nominal voltage of the motor. The connection is still preferable because the current and the voltage are lower than in a case where the power correction should be carried out during the whole cycle. Above all, the value at the external inductance L1 may be lower because the voltage is lower when the switching is carried out.

The above description and the related figures are only intended to illustrate a present solution for the structure of a sanding machine. Thus, the solution is not confined merely to the above or the embodiment described in the attached claims, but a plurality of variations or alternative embodiments are feasible within the idea described in the attached claims.

The invention claimed is:

1. A hand-held sanding machine, comprising:

an outer housing (1);

a tool shaft (2) having an eccentrically positioned tool holder; and a brushless electric drive motor having a stator (6) positioned in the outer housing (1), having a rotor (7) fastened to the tool shaft (2), and lacking a shaft of its own and further including a control unit (15), where the mains voltage is rectified and the following capacitor (C2) is so small that the voltage follows the rectified mains voltage and thus current is consumed from the network during the time when the voltage is loaded, characterized in that the motor is dimensioned in such a way that the nominal voltage of the motor is so much lower than the top value of the rectified mains voltage in relation to the required power that sufficient power correction is obtained when current is consumed during that part of the cycle when the voltage is higher than the nominal voltage of the motor and no current is consumed when the voltage is lower than the nominal voltage of the motor.

2. A sanding machine according to claim 1, wherein the motor is slotless.

3. A sanding machine according to claim 1, wherein the motor is cooled by a blower (9) mounted on the tool shaft (2).

4. A sanding machine according to claim 1, wherein the stator (6) is cooled by cooling air flowing through a slot generated between the inside of the outer housing (1) and the outside of the stator (6).

5. A sanding machine according to claim 1, wherein the stator (6) forms the outer housing (1).

6. A sanding machine according to claim 5, wherein the stator (6) has built-in cooling channels.

7. A sanding machine according to claim 1, further comprising a grinding disc (3) mounted on the tool shaft (2) eccentrically freely rotationally.

8. A sanding machine according to claim 1, further comprising a grinding disc (3) with or without reduction gear mounted on the tool shaft (2) to generate rotating movement.

9. A sanding machine according to claim 1, further comprising a control unit that maintains a constant speed of rotation of the motor irrespective of the load on the motor.

10. A sanding machine according to claim 1, characterized in that the relation between current and voltage is optimized in that part of the cycle in which the voltage is higher than the nominal voltage of the motor so that smallest harmonic component possible is generated, and thus also the best possible power correction is obtained.

11. A sanding machine according to claim 1, characterized in that power correction is carried out also during that time when the rectified voltage is lower than the nominal voltage of the motor.

12. A sanding machine according to claim 1, characterized in that the switched power aggregate uses only the motor's own inductance (L1) as the inductive component in the switching.

13. A hand-held sanding machine according to claim 1 wherein, the motor is controlled by a sensorless control unit.

14. A sanding machine according to claim 13, characterized in that the motor is controlled by a sensorless control unit so that the position of the rotor in the electronic commutation is determined by the voltage generated in the phase that is not conducting.

15. A sanding machine according to claim 13, characterized in that the motor is controlled by a sensorless control unit so that the position of the rotor in the electronic commutation is determined by the currents generated in the different phases or the relation between current and voltage in the phases.

16. A control method for an electric sanding machine, which method comprises rectification of the mains voltage and switched motor control, characterized by the motor being dimensioned in such a way that the nominal voltage of the motor is so much lower than the top value of the rectified mains voltage in relation to the required power that sufficient power correction is obtained when current is consumed during that part of the cycle when the voltage is higher than the nominal voltage of the motor and no current is consumed when the voltage is lower than the nominal voltage of the motor.

17. A control method according to claim 16, characterized by the relation between current and voltage is optimized in that part of the cycle in which the voltage is higher than the nominal voltage of the motor so that smallest harmonic components possible are generated and, thus also the best possible power correction is obtained.

* * * * *